United States Patent [19]

Voloshin et al.

[11] 4,143,870

[45] Mar. 13, 1979

[54] FOLDER DELIVERY ARRANGEMENT FOR REEL-FED ROTARY PRINTING FOR PRESSES

[76] Inventors: Rafail Y. Voloshin, ulitsa Bulvar Verkhovnogo Soveta, 25a, kv. 70, Kiev; Leonid P. Grachev, ulitsa Serafimovicha, 2, kv. 181; Grigory A. Radutsky, 16 Parkovaya ulitsa 49, korpus 2, kv. 68, both of Moscow; Rafail E. Kheifets, Chernobelskaya ulitsa, 3, kv. 63, Kiev, all of U.S.S.R.

[21] Appl. No.: 709,212

[22] Filed: Jul. 27, 1976

[30] Foreign Application Priority Data

Jul. 29, 1975 [SU] U.S.S.R. ..... 2153401

[51] Int. Cl.[2] ..... B65H 45/02; B65H 39/12

[52] U.S. Cl. ..... 270/47; 270/20; 270/82; 414/49; 414/53

[58] Field of Search ..... 270/6, 7, 10, 11, 13, 270/14, 19, 38, 42, 47–50, 21, 60, 82, 85, 20; 214/6 G, 6 H; 101/136, 237, 238, 240

[56] References Cited

FOREIGN PATENT DOCUMENTS 2452920 6/1975 Fed. Rep. of Germany ..... 270/82

*Primary Examiner*—Edgar S. Burr
*Assistant Examiner*—A. Heinz
*Attorney, Agent, or Firm*—Lackenbach, Lilling & Siegel

[57] ABSTRACT

The present invention relates to folder delivery arrangements for reel-fed rotary printing presses. The arrangement comprises driven finger-type lay-down devices under each of which a box receptacle is provided for receiving newspaper prints and forming piles thereof, said box receptacle having a pallet vertically traversable by means of mechanism mechanically interlinked with the drive shaft of the finger-type lay-down devices through a cam-operated mechanism. The cam of said mechanism has such a contour as to provide downward traversing of the box pallet at the speed required for the lay-down fingers to periodically press the folds of the newspaper prints in the pile when every next print is placed upon the top one in the pile which is being formed on the box pallet during its downward traverse.

3 Claims, 4 Drawing Figures

FOLDER DELIVERY ARRANGEMENT FOR REEL-FED ROTARY PRINTING FOR PRESSES

The present invention relates generally to reel-fed rotary printing presses, and has particular reference to delivery arrangements of the folder of such presses.

The invention is concerned with further improvements of the earlier filed application of the same inventors.

The invention can be utilized to best advantage when applied to reel-fed rotary printing presses involved in printing newspapers delivered from the folder in a continuous stream.

In the earlier application a reel-fed rotary printing press had been described in detail, said press comprising a folder at the delivery end of which an arm is provided to control the direction of the stream of newspaper prints; two finger-type lay-down devices arranged together with their drive under said arm; and box receptacles provided beneath each of said lay-down devices to receive the newspaper prints and to stack them into piles, each of the box receptacles having a pallet vertically traversable by the newspaper prints piling mechanism. Provided near each of the box receptacles is a means for piece-by-piece pressing of the folds of the newspaper prints in the pile, said means being made as a double-blade rotary brush adapted to exert pressure upon the fold of every newspaper print being piled.

To attain an effective pile pressing, the length of the brush blade must be sufficiently which hampers putting it between two consecutively delivered prints at high printing speeds.

Furthermore, the force exerted by the brush blade is inadequate to press all the folds in the pile which, in turn, results in pile looseness. This impedes subsequent treatment of the pile, viz., putting the piles into bundles and packing the latter.

It is a primary object of the present invention to eliminate the disadvantages mentioned above.

It is another object of the present invention to provide a folder delivery arrangement for reel-fed rotary printing presses, wherein the mechanism for vertical traversing of the box pallet for newspaper prints would be made so that all the folds of the prints in the pile could be periodically pressed by the fingers of the lay-down device in the course of pile formation.

It is another object of the invention to provide a delivery arrangement featuring a constructional embodiment of the mechanism for the box pallet vertical traversing and capable of forming piles of newspaper prints having different numbers of pages in the same box receptacles.

It is another important object of the present invention to provide a delivery arrangement that would ensure apart from the above named objects freedom from the setting-off effect of letter-press ink upon exertion of the lay-down finger on the newspaper print.

These and other objects are accomplished by a folder delivery arrangement for reel-fed rotary printing presses, wherein according to the invention each of the box pallet vertical traversing mechanisms is mechanically linked to the drive shaft of the finger-type lay-down device by a cam-operated mechanism whose cam has such a contour as to provide downward traversing of the box pallet at the speed required for the fingers of the lay-down device to periodically press the folds of newspaper prints in the pile when every next newspaper print is placed on the top one in said pile that is being formed on the box pallet during its downward traversing.

Such a constructional arrangement provides for pressing of the folds of all the prints in the pile as the rigidity of the lay-down fingers is much superior to that of the brush blades and the force exerted by said fingers is great enough to press all the pile. Therefore the pile is compact and suitable for being transferred for further treatment, i.e., bundling and bundle packing.

Notwithstanding such a high rigidity of the lay-down fingers no setting off of the newspaper prints occurs since the lay-down finger contacts each print only once when pressing the fold.

Freedom from the setting-off effect during pressing of the pile is also accounted for by the fact that the pile formation takes place in the gap between the finger-type lay-down and the traversable box pallet, and the maximum depth of said gap is greater than the total thickness of the newspaper prints that form the pile.

To obtain piles formed by newspapers of different numbers of pages in the same box receptacles, according to the invention the portion of the cam contour corresponding to the downward traverse of the box pallet during pile formation is built of two segments of which one is adjacent to the initial point of said cam contour portion and is hinge-mounted and the other segment is adjacent to the end of said portion and is radially traversable, provision being made for a mechanism for simultaneous swivelling and traversing of the respective one of said segments for said portion of the cam contour to change, whereby the speed of the box pallet downward motion is varied. Said mechanism comprises a shifter set on the cam spindle, said shifter having stops, each of which being located in a slot provided in each of the cam segments and being adapted to move along said slot when the shifter is operated.

For a better understanding the invention is described below in detail by way of example with reference to the accompanying drawings, wherein.

Figure 1:
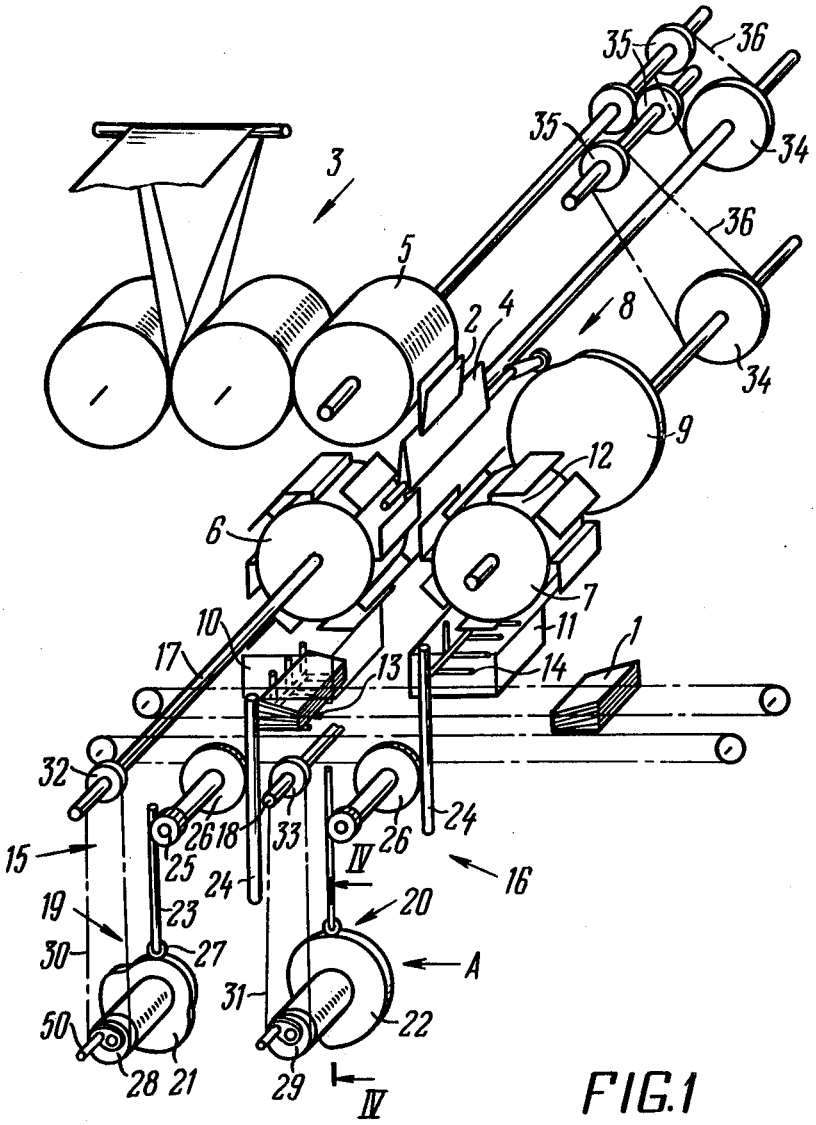
FIG. 1 is a perspective view of a folder delivery arrangement, according to the invention.

The delivery arrangement of piles 1 (FIG. 1) of newspaper prints 2 discharged from a folder 3 of a reel-fed rotary printing press (not shown) comprises a shiftable arm 4 situated under a folding cylinder 5 to direct the folded-up newspaper prints 2 to a finger-type lay-down device 6 or 7. The arm 4 is shifted according to, for instance, a fixed program from a cam-operated mechanism 8 whose cam 9 is made so that once every 50th newspaper print has arrived at one of said finger-type lay-down devices, the arm is shifted for delivering the prints to the other lay-down device. Provided beneath each of the finger-type lay-down devices 6 and 7 are respective box receptacles 10 and 11 adapted to receive the newspaper prints from pockets 12 of said lay-down devices and to put the prints on vertically traversable box pallets 13 and 14.

Said vertical traverse of each of the box pallets 13 and 14 is imparted by a respective mechanism 15 or 16 mechanically linked to a respective drive shaft 17 or 18 of the finger-type lay-down device 6 or 7 by a cam-operated mechanism 19 or 20. The contour of the cam 21 or 22 of the respective mechanism 19 or 20 provides for the box pallet 13 or 14 to move down at the speed required for the fingers of the lay-down device 6 or 7 to periodically press the folds of the newspaper prints in the pile 1 when every next print is placed upon the top print in said pile which is formed on the box pallet 13 or 14 during its downward traversing.

Each of the mechanisms 16 and 15 comprises two toothed racks 23 and 24 adapted to engage with a respective pinion 25 or 26, the rack 23 carrying a roller 27 which rides over the respective cam 21 or 22 of the mechanism 19 or 20, the other rack 24 being locked-in with the respective box pallet 13 or 14.

Each of the cam-operated mechanisms 19, 20 comprises, apart from the cam 21 or 22, sprockets 28, 29 which interconnect through chains 30, 31 with other sprockets 32, 33, the sprocket 32 being set on the shaft 17 of the finger-type lay-down device 6, and the sprocket 33 being set on the shift 18 of the lay-down device 7. The shafts 17 and 18 are imparted rotation by any conventional drive mechanism, such as sprockets 34 and 35 interconnected by a chain 36.

Figure 2:
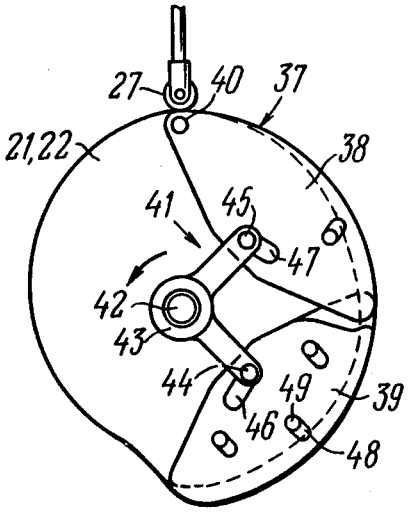
FIG. 2 is a view in the direction of the arrow "A" in FIG. 1 showing one of the cam segments swivelled and the other cam segment radially displaced with respect to its initial position.
Figure 3:
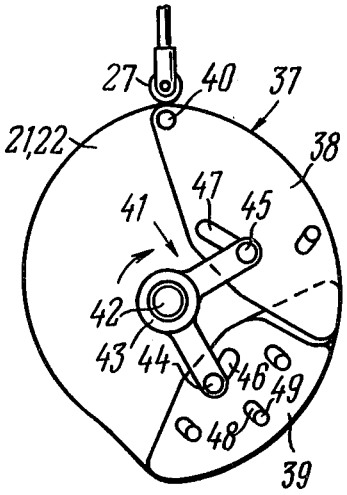
FIG. 3 is a view of FIG. 2 showing both segments occupying the initial position.
Figure 4:
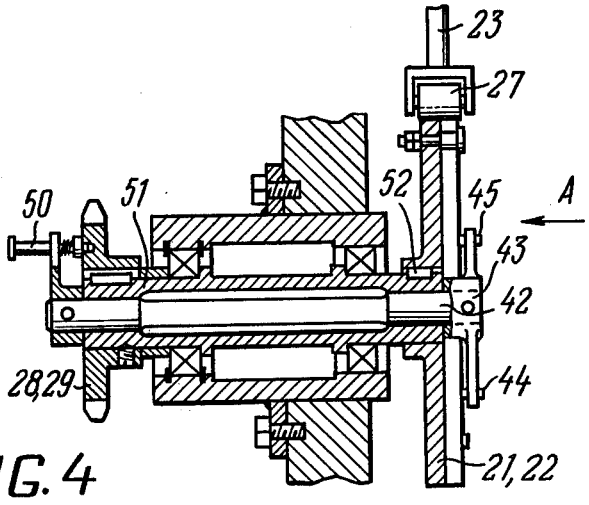
FIG. 4 is a cross sectional view taken along the line IV—IV in FIG. 1.

The required traversing speed of the box pallet 13 or 14 is attained due to the fact that a portion 37 (FIGS. 2, 3) of the contour of the cam 21 or 22, corresponding to said reversing of the box pallet, is formed by two segments 38 and 39. The segment 38 adjacent to the initial point of said portion 37 is pivotally mounted on a hinge 40, while the segment 39 is radially movable. For simultaneous swivelling and traversing of the respective segments 38, 39 a mechanism 41 is provided. The mechanism comprises a shifter set on a spindle 42 of the cam 21 or 22, said shifter having stops 44 and 45 located in slots 46, 47 made in the respective segments 39 and 38. One more slot 48 is provided in the segment 39 for a pin 49 fixed in position on the cam 21 or 22. When in the extreme positions the segments 38 and 39 of the cam 21 or 22 are prevented from rotating by virtue of a retainer 50 (FIG. 4) adapted to exert upon the sprocket 28 or 29 which is set on the spindle 42 by means of a bush 51, the latter carrying the cam 21 or 22 which is fixed in place thereon by a key 52.

The delivery arrangement operates as follows.

On placing the printing press in operation, the newspaper prints 2 folded up on the folding cylinder 5 are directed by the arm 4 successively into one of the two finger-type lay-down devices 6 and 7 which, while rotating, puts said prints onto the box pallet 13 or 14 of one of the box receptacles 10 and 11. On account of the fact that the box pallets are interlinked with the drive shafts 17, 18 of the finger-type lay-down devices 6, 7 through the cams 21, 22 and through the kinematic chain comprising the members 24, 26, 25, 23, 27, 28, 29, 30, 31, 32, 33, as well as due to a preset contour of the cams 21, 22, said box pallets move down at the speed required for the lay-down fingers to periodically press the folds of the newspaper prints in the pile. Said periodical action occurs when placing every next print upon the top print in the pile which is being formed on the moving down box pallet.

As the pile formation occurs in the gap between the finger-type lay-down device and the traversable box pallet, the maximum depth of said gap depends upon the thickness of a newspaper print, i.e., the number of pages or sheets therein, so in order to form piles of newspapers with different numbers of pages in the same box receptacle, the contour of the cam 21, 22 must be changed. Thus e.g., to form piles of four-page newspapers, the segments 38, 39 of the cam 21, 22 assume the position shown in FIG. 2. To attain said position, the shifter 43 is operated to pivot the segment 38 round the hinge 40 and to radially displace the segment 39 along the slot 48. When forming piles of eight-page newspapers which are twice as thick as the four-page ones, the difference between the initial and end points of the cam contour portion 37 must be doubled as well. This is achieved by returning the segments 38, 39 to the position illustrated in FIG. 3, whereby the downward traversing speed of the box pallet 13, 14 is increased.

By the difference between the initial and end points of the cam lobe contour, it should be meant the difference between the distances from the cam axis to the points corresponding to the start and end of the cam lobe contour portion 37.

We claim:

1. A folder delivery arrangement in reel-fed rotary printing presses, comprising: a driven arm for changing the direction of movement of newspaper prints discharged from the folder, said arm being located at the discharge end of said folder; finger-type lay-down devices for receiving newspaper prints delivered by said arm being located under the arm; drive shafts on which said finger-type lay-down devices are carried; a driving means for said shafts of said finger-type lay-down devices; comb-shaped stops of said finger-type lay-down devices; two box receptacles, one being located beneath each of said comb-shaped stops for receiving the newspaper prints delivered by the finger-type lay-down devices and for forming a pile of said newspaper prints; a box pallet for each box receptacle supported for vertical movement during pile formation; a mechanism for vertically moving said box pallet of each of said box receptacles; a roller table provided below said box receptacles for withdrawal of a formed pile; an improvement in said delivery arrangement being that said box pallet vertical moving mechanism is mechanically associated with the drive shaft of the finger-type lay-down devices by a cam-operated mechanism, the cam of said mechanism having a contour sufficient to provide downward movement of the box pallet at the speed required for the lay-down fingers to periodically press the folds of the newspaper prints in the pile when every next print is placed upon the top one in the pile.

2. A delivery arrangement as claimed in claim 1, wherein the contour of the portion of said cam corresponding to the downward movement of the box pallet during pile formation is made of two segments, one of which being adjacent to an initial point of said cam portion and pivotally mounted, and the other segment being adjacent to an end point of said cam portion and is radially traversable; and further comprising means for simultaneously imparting swivelling and radial displacement to the respective one of said segments so as to change the cam contour on said portion, whereby the downward speed of the box pallet is varied.

3. A delivery arrangement as claimed in claim 2, wherein said means for simultaneous swivelling and radial displacement of the respective cam segments comprises a shifter set on a spindle of the cam and having stops, each of which being accommodated in a slot made in each of the segments and moving traversably therealong when the shifter is operated.

* * * * *